US007631500B2

(12) United States Patent
Mueller et al.

(10) Patent No.: US 7,631,500 B2
(45) Date of Patent: Dec. 15, 2009

(54) METHODS AND APPARATUS TO FACILITATE DECREASING COMBUSTOR ACOUSTICS

(75) Inventors: Mark Anthony Mueller, West Chester, OH (US); Timothy James Held, Blanchester, OH (US); Mark Patrick Kelsey, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 664 days.

(21) Appl. No.: 11/537,100

(22) Filed: Sep. 29, 2006

(65) Prior Publication Data

US 2008/0078181 A1 Apr. 3, 2008

(51) Int. Cl.
*F02C 1/00* (2006.01)
*F02G 3/00* (2006.01)

(52) U.S. Cl. ..... 60/748; 60/737; 239/399

(58) Field of Classification Search ..... 60/737, 60/748, 776; 239/399, 403, 405
See application file for complete search history.

(56) References Cited

U.S. PATENT DOCUMENTS 5,099,644 A 3/1992 Sabla et al.
5,351,477 A * 10/1994 Joshi et al. ..... 60/39.463
5,406,799 A 4/1995 Marshall
5,451,160 A 9/1995 Becker
5,675,971 A 10/1997 Angel et al.
5,680,766 A 10/1997 Joshi et al.
5,778,676 A 7/1998 Joshi et al.
5,850,732 A 12/1998 Willis et al.
5,865,024 A * 2/1999 Kress et al. ..... 60/39.463
6,058,710 A 5/2000 Brehm
6,381,964 B1 * 5/2002 Pritchard et al. ..... 60/746
6,438,961 B2 8/2002 Tuthill
6,453,658 B1 9/2002 Willis et al.
6,532,726 B2 3/2003 Norster et al.
6,655,145 B2 * 12/2003 Boardman ..... 60/737
6,968,692 B2 11/2005 Chin et al.
7,140,560 B2 * 11/2006 Stotts et al. ..... 239/461
7,490,471 B2 * 2/2009 Lynch et al. ..... 60/748
7,565,803 B2 * 7/2009 Li et al. ..... 60/748
2008/0078179 A1 * 4/2008 Cai ..... 60/748
2008/0148736 A1 * 6/2008 Ishizaka et al. ..... 60/737
2009/0056336 A1 * 3/2009 Chila et al. ..... 60/737

* cited by examiner

*Primary Examiner*—William H Rodríguez
(74) *Attorney, Agent, or Firm*—William Scott Andes, Esq.; Armstrong Teasdale LLP

(57) ABSTRACT

A method for operating a combustion system is provided. The method includes coupling the main swirler to the pilot swirler such that the main swirler substantially circumscribes the pilot swirler, supplying fuel to a first fuel circuit defined in the main swirler, and inducing swirling to the supplied fuel via a first set of swirler vanes positioned within the main swirler. The method also includes supplying fuel to a second fuel circuit defined in the main swirler, inducing swirling to the supplied fuel via a second set of swirler vanes positioned within the main swirler, each of the second set of swirler vanes comprising at least one second fuel passage defined therein, and coupling a shroud in flow communication to at least one of the first set of swirler vanes and the second set of swirler vanes, the shroud comprising at least one third fuel passage defined therein.

20 Claims, 6 Drawing Sheets

METHODS AND APPARATUS TO FACILITATE DECREASING COMBUSTOR ACOUSTICS

BACKGROUND OF THE INVENTION

This invention relates generally to combustors and more particularly, to methods and apparatus to facilitate decreasing combustor acoustics.

During the combustion of natural gas, pollutants such as, but not limited to, carbon monoxide ("$CO_2$"), unburned hydrocarbons ("UHC"), and nitrogen oxides ("$NO_x$") may be formed and emitted into an ambient atmosphere. At least some known emission sources include devices such as, but not limited to, gas turbine engines and other combustion systems. Because of stringent emission control standards, it is desirable to control emissions of such pollutants by the suppressing formation of such emissions.

At least some known combustion systems implement combustion modification control technologies such as, but not limited to, Dry-Low-Emissions ("DLE") combustors and other lean pre-mixed combustors to facilitate reducing emissions of pollutants from the combustion system by using pre-mixed fuel injection. For example, at least some known DLE combustors attempt to reduce the formation of pollutants by lowering a combustor flame temperature using lean fuel-air mixtures and/or pre-mixed combustion. However, at least some known DLE combustors experience combustion acoustics that can limit the operability and performance of a combustion system that includes such known DLE combustor.

Known strategies employed in an effort to reduce combustion acoustics include the following: (1) passive damping of pressure fluctuations with quarter-wave tubes, resonators, acoustic liners/baffles, and/or other acoustic damping devices; (2) incorporating design features into premixers to facilitate desensitizing a fuel-air mixing with respect to pressure fluctuations from a combustion chamber; (3) operating the combustor with significant variation in flame temperatures between individual domes of multidome combustors or individual premixers of singular annular combustors; (4) open-loop active control to introduce off-resonant fluctuations in fuel and/or air flows to facilitate weakening resonant modes; and/or (5) closed-loop active control methods that respond in real time to facilitate disturbing fuel and/or air flows in such a manner as to decouple physical processes responsible for feedback between pressure oscillations and heat release.

At least some known DLE combustors include both passive and active control features to facilitate suppressing combustion acoustics such as, but not limited to, combustion-inducing acoustic waves and combustion-inducing pressure oscillations that may be formed as a result of combustion instabilities that may be generated when a pre-mixed fuel and compressed air ignite. For example, quarter wave tubes have been used to passively damp pressure fluctuations adjacent to premixer inlets. Also, supplemental fuel circuits such as Enhanced Lean Blow-Out ("ELBO") fuel circuits have been used in known pilot swirlers to actively inject smaller amounts of fuel into the combustor at a different location than a primary fuel injection location.

Compared to primary fuel circuits, ELBO fuel circuits generally require a shorter convective timescale for an ELBO fuel-air mixture to travel from a point of injection to a flame front where heat release occurs. As such, an acoustic frequency interacts differently with the ELBO fuel-air mixing at an ELBO fuel injection location as compared to primary fuel-air mixing at a primary injection location. As a result, fuel-air mixture fluctuations that are out-of-phase with respect to each other and at least one fuel-air mixture fluctuation that is out-of-phase with respect to pressure fluctuations in the combustor are generated to facilitate reducing combustion acoustics by reducing an amplitude of pressure fluctuations in the DLE combustor.

However, combustion of lean fuel-air mixtures generates heat temperatures that are sensitive to any variation in the fuel-air ratio of the fuel-air mixture. Such variations in the fuel-air ratio may be caused by fluctuations in a flow rate of the fuel and/or a flow rate of the compressed air. Because fuel flow and/or compressed air flow through known DLE combustors may be turbulent, fluctuations in the fuel and/or compressed air flow rates may cause pressure disturbances in a combustion chamber/zone of such DLE combustors. If such pressure disturbances interact with a fuel-air mixing process, any heat being released may also fluctuate to reinforce an initial pressure disturbance. Over time, the increased amplitude of pressure disturbances may cause damage to portions of the DLE combustor. As a result, operability, emissions, maintenance cost, and life of combustor components may be negatively affected.

BRIEF DESCRIPTION OF THE INVENTION

In one aspect, a method for operating a combustion system including at least one premixer assembly that includes a pilot swirler and a main swirler is provided. The method includes coupling the main swirler to the pilot swirler such that the main swirler substantially circumscribes the pilot swirler, supplying fuel to a first fuel circuit defined in the main swirler, and inducing swirling to the fuel supplied to the first fuel circuit via a first set of swirler vanes positioned within the main swirler. Each of the first set of swirler vanes include at least one first fuel passage defined therein. The method also includes supplying fuel to a second fuel circuit defined in the main swirler and inducing swirling to the fuel supplied to the second fuel circuit via a second set of swirler vanes positioned within the main swirler. Each of the second set of swirler vanes includes at least one second fuel passage defined therein. The method further includes coupling a shroud in flow communication to at least one of the first set of swirler vanes and the second set of swirler vanes. The shroud includes at least one third fuel passage defined therein.

In another aspect, a combustion system is provided. The combustion system includes a pilot swirler and a main swirler coupled to the pilot swirler such that the main swirler substantially circumscribes the pilot swirler. The main swirler includes a first set of swirler vanes for inducing swirling to fuel supplied to a first fuel circuit defined in the main swirler. Each of the first set of swirler vanes includes at least one first fuel passage defined therein. The main swirler also includes a second set of swirler vanes for inducing swirling to fuel supplied to a second fuel circuit defined in the main swirler. Each of the second set of swirler vanes includes at least one second fuel passage defined therein. Further, the main swirler includes a shroud coupled in flow communication to at least one of the first set of swirler vanes and the second set of swirler vanes. The shroud includes at least one third fuel passage defined therein.

In another aspect, a fuel delivery apparatus is provided. The fuel delivery system includes a first set of swirler vanes for inducing swirling to fuel supplied to a first fuel circuit defined in the main swirler. Each of the first set of swirler vanes includes at least one first fuel passage defined therein. The fuel delivery system also includes a second set of swirler vanes for inducing swirling to fuel supplied to a second fuel circuit defined in the main swirler. Each of the second set of swirler vanes includes at least one second fuel passage defined therein. Further, the fuel delivery system includes a shroud coupled in flow communication to at least one of the first set of swirler vanes and the second set of swirler vanes. The shroud includes at least one third fuel passage defined therein.

DETAILED DESCRIPTION OF THE INVENTION

The exemplary methods and apparatus described herein overcome the disadvantages of known combustors by forming an Enhanced Lean Blow-Out fuel ("ELBO") fuel circuit that supplies ELBO fuel through a main swirler shroud to facilitate reducing combustion acoustics.

It should be appreciated that "forward" is used throughout this application to refer to directions and positions located axially upstream toward an fuel/air intake side of a combustion system for the ease of understanding. It should also be appreciated that "aft" is used throughout this application to refer to directions and positions located axially downstream toward an exit plane of a main swirler for the ease of understanding. Moreover, it should be appreciated that the term "ELBO" is used throughout this application to refer to various components of an Enhanced Lean Blow-Out fuel circuit, which is a supplemental fuel circuit that injects ELBO fuel that represents a relatively small portion of fuel injected as compared to an amount of main fuel supplied to a primary main fuel injector positioned within the combustor at a different location than the injector(s) for use with the ELBO fuel.

Figure 1:
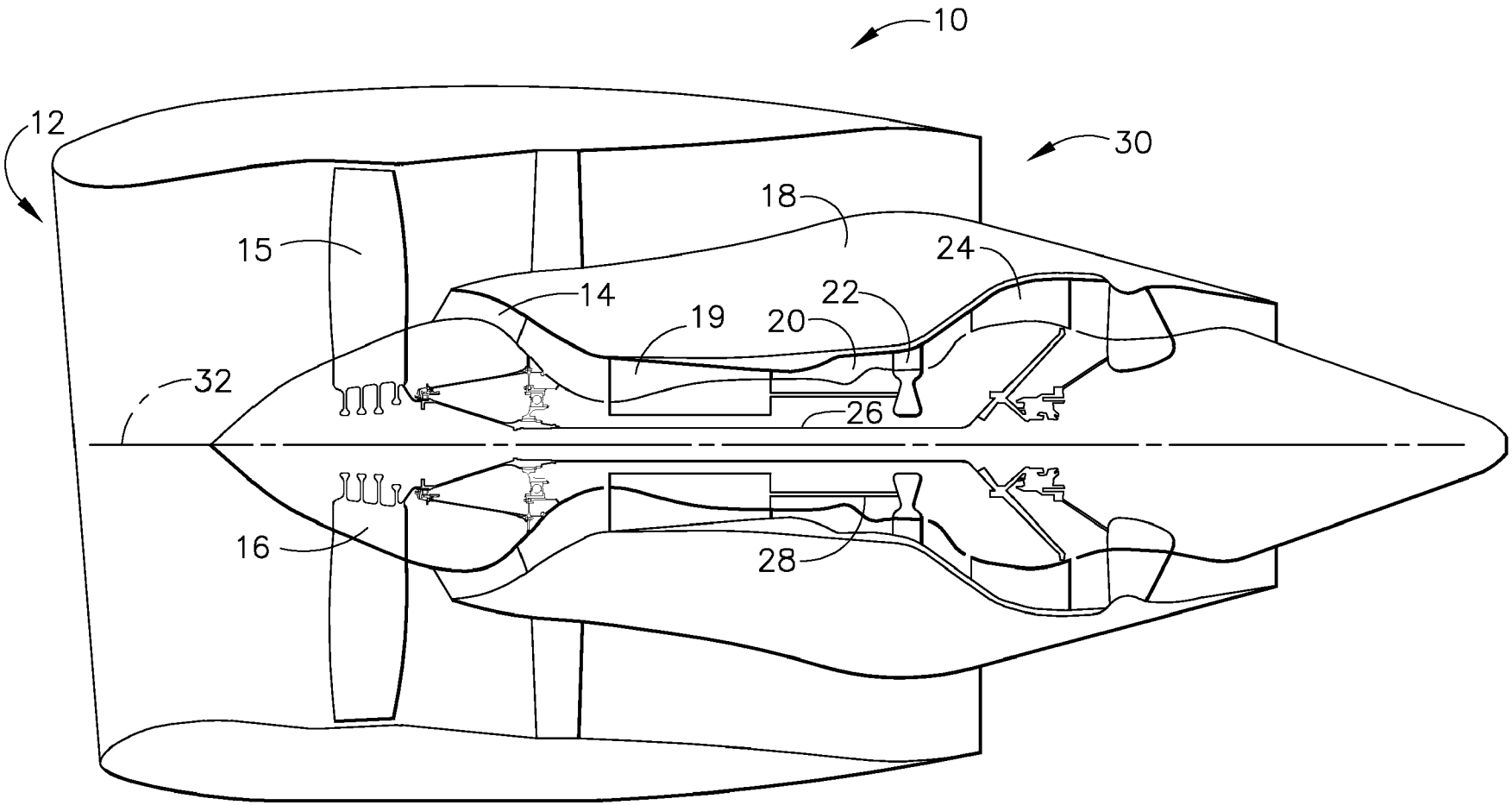
FIG. 1 is a schematic illustration of an exemplary gas turbine engine including a combustor.

FIG. 1 is a schematic illustration of an exemplary gas turbine engine 10 including an air intake side 12, a fan assembly 14, a core engine 18, a high pressure turbine 22, a low pressure turbine 24, and an exhaust side 30. Fan assembly 14 includes an array of fan blades 15 extending radially outward from a rotor disc 16. Core engine 18 includes a high pressure compressor 19 and a combustor 20. Fan assembly 14 and low pressure turbine 24 are coupled by a first rotor shaft 26, and high pressure compressor 19 and high pressure turbine 22 are coupled by a second rotor shaft 28 such that fan assembly 14, high pressure compressor 19, high pressure turbine 22, and low pressure turbine 24 are in serial flow communication and co-axially aligned with respect to a central rotational axis 32 of gas turbine engine 10. In one exemplary embodiment, gas turbine engine 10 may be a GE90 engine commercially available from General Electric Company, Cincinnati, Ohio.

During operation, air enters through air intake side 12 and flows through fan assembly 14 to high pressure compressor 19. Compressed air is delivered to combustor 20. Airflow from combustor 20 drives high pressure turbine 22 and low pressure turbine 24 prior to exiting gas turbine engine 10 through exhaust side 30.

Figure 2:
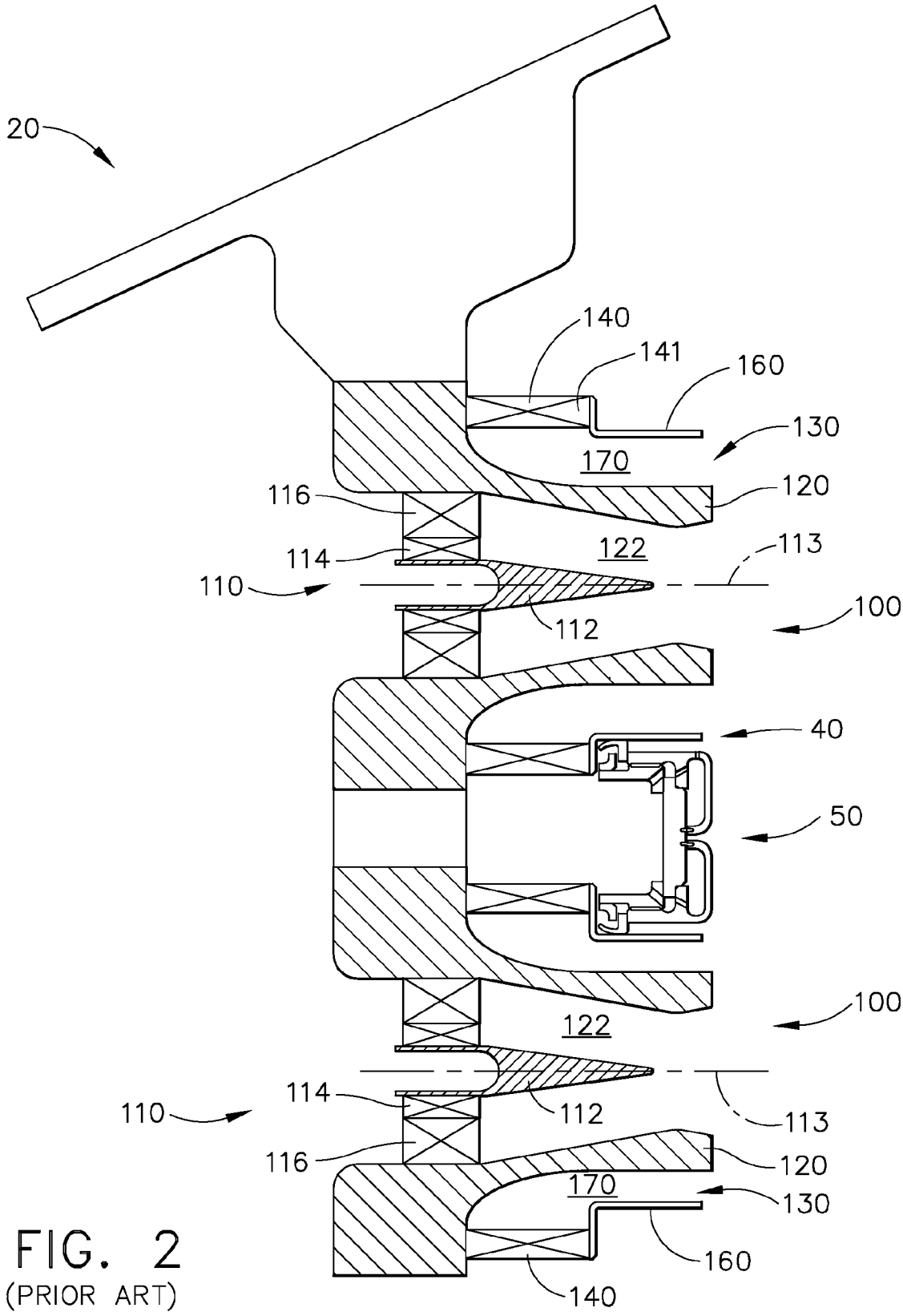
FIG. 2 (PRIOR ART)
FIG. 2 is a cross-sectional view of a portion of an exemplary known combustor including a premixer assembly that may be used with the gas turbine engine shown in FIG. 1.
Figure 3:
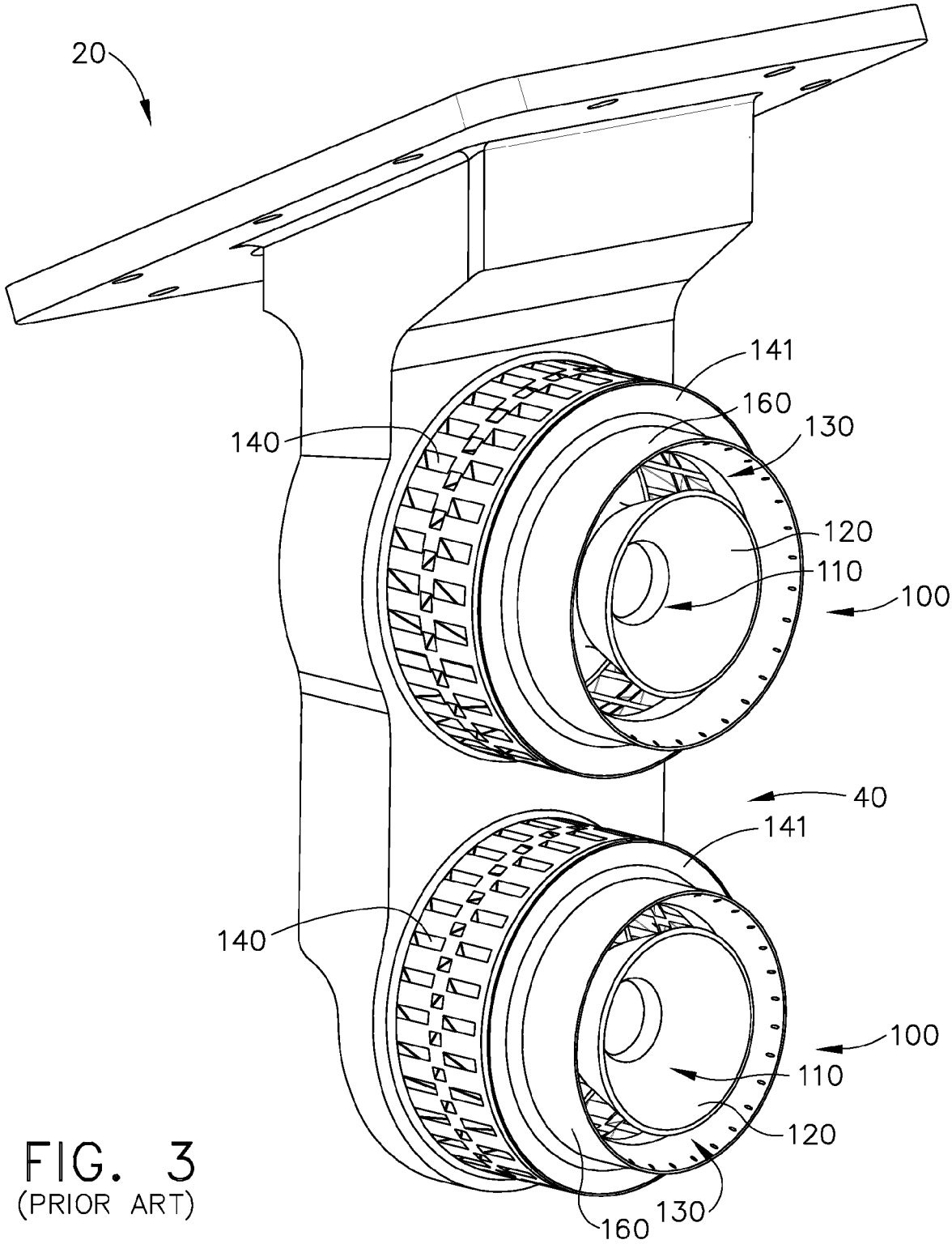
FIG. 3 (PRIOR ART)
FIG. 3 is a perspective view of the portion of the known combustor shown in FIG. 2.

FIG. 2 is a cross-sectional view of a portion of known combustor 20 including a premixer assembly 100 that may be used with a gas turbine engine, such as gas turbine engine 10 shown in FIG. 1. FIG. 3 is a perspective view of the portion of known combustor 20 including premixer assembly 100. In the exemplary embodiment, combustor 20 includes a combustion chamber/zone 40 that is defined by annular liners (not shown), at least one combustor dome 50 that defines an upstream end of combustion zone 40, and a plurality of premixer assemblies 100 that are circumferentially-spaced about each combustor dome 50 to deliver a fuel/air mixture to combustion zone 40.

In the exemplary embodiment, each premixer assembly 100 includes a pilot swirler 110, an annular centerbody 120, and a main swirler 130. Pilot swirler 110 includes a pilot centerbody 112 having a central rotational axis 113, an inner annular swirler 114, and a concentrically disposed outer annular swirler 116. Inner annular swirler 114 is circumferentially disposed about pilot centerbody 112 and co-axially aligned with central rotational axis 113. Outer annular swirler 116 is circumferentially disposed about pilot centerbody 112 and inner annular swirler 114, and co-axially aligned with central rotational axis 113.

Annular centerbody 120 is circumferentially disposed about pilot centerbody 112, inner annular swirler 114, and outer annular swirler 116. Annular centerbody 120 is also co-axially aligned with central rotational axis 113 and defines a centerbody cavity 122. Further, annular centerbody 120 extends between pilot swirler 110 and main swirler 130. Main swirler 130 includes a plurality of main swirler vanes 140 and an annular main swirler shroud 160 that defines an annular main swirler cavity 170. Main swirler shroud 160 is coupled to, and extends aftward from, an aft end 141 of main swirler vanes 140.

Figure 4:
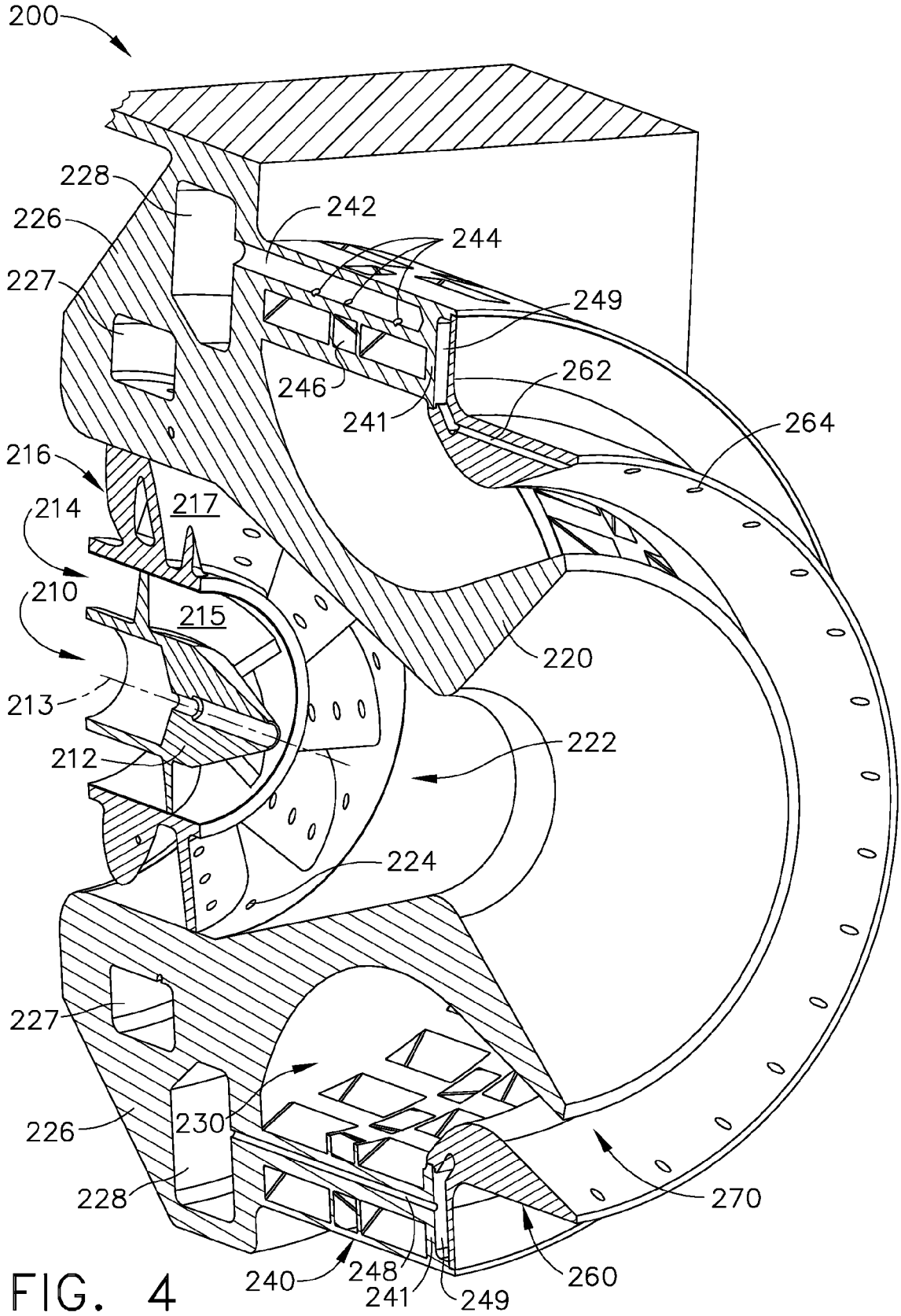
FIG. 4 is an enlarged cross-sectional view of an exemplary premixer assembly that may be used with the combustor shown in FIGS. 2 and 3.

FIG. 4 is an enlarged cross-sectional view of an exemplary premixer assembly 200 that may be used with the combustor 20 shown in FIGS. 2 and 3. In the exemplary embodiment, premixer assembly 200 includes a pilot swirler 210, an annular centerbody 220, and a main swirler 230. Pilot swirler 210 includes a pilot centerbody 212 having a central rotational axis 213, an inner annular swirler 214, and a concentrically disposed outer annular swirler 216. Inner annular swirler 214 includes a plurality of inner pilot vanes 215 circumferentially disposed about pilot centerbody 212, and is co-axially aligned with central rotational axis 213. Outer annular swirler 216 includes a plurality of outer pilot vanes 217 circumferentially disposed about pilot centerbody 212 and inner annular swirler 214, and is co-axially aligned with central rotational axis 213.

Annular centerbody 220 is co-axially aligned with central rotational axis 213 and defines a centerbody cavity 222. Annular centerbody 220 also includes a plurality of orifices 224 coupled, in flow communication, to centerbody cavity 222. Moreover, annular centerbody 220 includes a forward end portion 226 defining an annular pilot swirler fuel manifold 227 and an annular main swirler fuel manifold 228. Further, annular centerbody 220 extends between pilot swirler 210 and main swirler 230 to control fuel flow through premixer assembly 200.

Main swirler 230 includes a plurality of main swirler vanes 240 and an annular main swirler shroud 260 that both define an annular main swirler cavity 270. Main swirler vanes 240 include aft ends 241 and are annularly arranged about annular centerbody 220. Moreover, each main swirler vane 240 includes a plurality of fuel passages.

In the exemplary embodiment, a first subset of main swirler vanes 240 each include a first primary fuel passage 242, a plurality of injection orifices 244, and a plurality of intermediate primary fuel/air passages 246. Moreover, the first subset of main swirler vanes 240 each partially define an aft Enhanced Lean Blow-Out ("ELBO") fuel manifold 249. First primary fuel passage 242 is coupled, in flow communication, with main swirler 230 via injection orifices 244. Because first primary fuel passage 242 does not extend across the entire length of main swirler vane 240, first primary fuel passage 242 is not coupled, in flow communication to aft ELBO fuel manifold 249.

A second subset of main swirler vanes 240 each include a second primary fuel passage 248. Moreover, the second subset of main swirler vanes 240 each partially define aft ELBO fuel manifold 249. Because second primary fuel passage 248 extends across the entire length of respective main swirler vane 240, the second subset of main swirler vanes 240 are coupled, in flow communication, to aft ELBO fuel manifold 249. In the exemplary embodiment, main swirler vanes 240 are circumferentially arranged about central rotational axis 213 such that each first subset main swirler vane 240 alternates with each second subset main swirler vane 240.

Annular main swirler shroud 260 is coupled to, and extends aftward from, aft ends 241 of main swirler vanes 240 to partially define each aft ELBO fuel manifold 249. Moreover, annular main swirler shroud 260 includes main ELBO fuel passages 262 and a plurality of ELBO fuel openings 264. Each ELBO fuel opening 264 is coupled, in flow communication, to a respective aft ELBO fuel manifold 249.

During operation of the associated combustor, such as DLE combustor 20 (shown in FIGS. 1-3), a fuel delivery system uses a pilot fuel circuit and a main fuel circuit to supply fuel to a combustion zone, such as combustion zone 40 (shown in FIGS. 1-3). The pilot fuel circuit supplies pilot fuel (not shown) to pilot swirler 210 via pilot swirler fuel manifold 227. Fuel and air are mixed in inner and outer annular swirlers 214 and 216 respectively, and the fuel-air mixture is supplied through inner pilot vanes 215 and 217 to centerbody cavity 222. Additionally, pilot fuel may also be supplied to pilot swirler 210 via orifices 224.

The main fuel circuit includes a main primary fuel circuit and a main ELBO fuel circuit that supply fuel to main swirler 230 via main swirler fuel manifold 228. In the main primary fuel circuit, the first subset of main swirler vanes 240 each include first primary fuel passage 242 coupled, in flow communication, to intermediate primary fuel/air passages 246 via injection orifices 244. As a result, main primary fuel (not shown) is supplied from main swirler fuel manifold 228 to a primary main fuel injection location. Specifically, main primary fuel is supplied to a portion of main swirler cavity 270 positioned forward of annular main swirler shroud 260.

In the main ELBO fuel circuit, the second subset of main swirler vanes 240 each include second primary fuel passage 248 coupled, in flow communication, to aft ELBO fuel manifold 249. As a result, ELBO fuel (not shown) is supplied from main swirler fuel manifold 228 to a secondary main fuel injection location. More specifically, in the exemplary embodiment, ELBO fuel is supplied to a portion of main swirler cavity 270 positioned aft of the first and second subsets of main swirler vanes 240 and adjacent a fuel-air mixture injection exit plane of main swirler 230.

ELBO fuel is a relatively small portion of the main fuel that is supplied as supplemental fuel into a combustor as compared to an amount of main fuel supplied to a primary main fuel injection location. However, ELBO fuel is supplied into the combustor at a different location than the primary main fuel injection location. More specifically, in the exemplary embodiment, ELBO fuel is supplied downstream of the primary main fuel injection location. Because ELBO fuel is a relatively small portion of the main fuel, it is desirable to control an amount of ELBO fuel supplied by controlling an amount and/or size of second primary fuel passages 248.

In the exemplary premixer assembly 200, compared to the primary fuel circuit, the ELBO fuel circuit requires a shorter convective timescale for an ELBO fuel-air mixture to travel from the secondary main fuel injection location to the combustion zone, such as combustion zone 40, where heat release occurs. Therefore, an acoustic frequency interacts differently with ELBO fuel-air mixing at the secondary main fuel injection location as compared to the primary fuel-air mixing at primary main fuel injection location. Moreover, fuel-air mixture fluctuations that are out-of-phase with respect to each other and at least one fuel-air mixture fluctuation that is out-of-phase with respect to the pressure fluctuations in DLE combustors are generated.

Because ELBO fuel circuit facilitates reducing, in a fuel-air mixture, any fuel-air ratio variation that may be caused by fluctuations in a flow rate of fuel and/or a flow rate of compressed air, ELBO fuel circuit facilitates reducing combustion acoustics by reducing an amplitude of pressure fluctuations in DLE combustors. Moreover, ELBO fuel circuit facilitates reducing pressure disturbances in a combustion chamber/zone, such as combustion zone 40, of DLE combustors so that pressure disturbances do not interact with a fuel-air mixing process to reinforce an initial pressure disturbance. Therefore, ELBO fuel circuit facilitates reducing an amplitude of pressure disturbances that may damage portions of the DLE combustor. As a result, in the exemplary embodiment, ELBO fuel circuit facilitates increasing operability, reducing emissions, reducing maintenance cost, and increasing life of combustor components.

In the exemplary embodiment, the first and second subsets of main swirler vanes 240 are respectively coupled, in flow communication, to primary and secondary main fuel injection locations. As a result, every main swirler vane 240 cannot be used to inject main fuel and ELBO fuel into primary main fuel injection location of main swirler cavity 270. Therefore, premixer assembly 200 does not facilitate optimizing a level of fuel-air mixing in primary main fuel injection location to control pollutant formation and combustion acoustics. However, only one fuel manifold, such as main swirler fuel manifold 228, is required to supply fuel to each of main primary fuel circuit and main ELBO fuel circuit. As a result, such arrangement facilitates distributing a fixed percentage of ELBO fuel to the secondary main fuel injection location.

Figure 5:
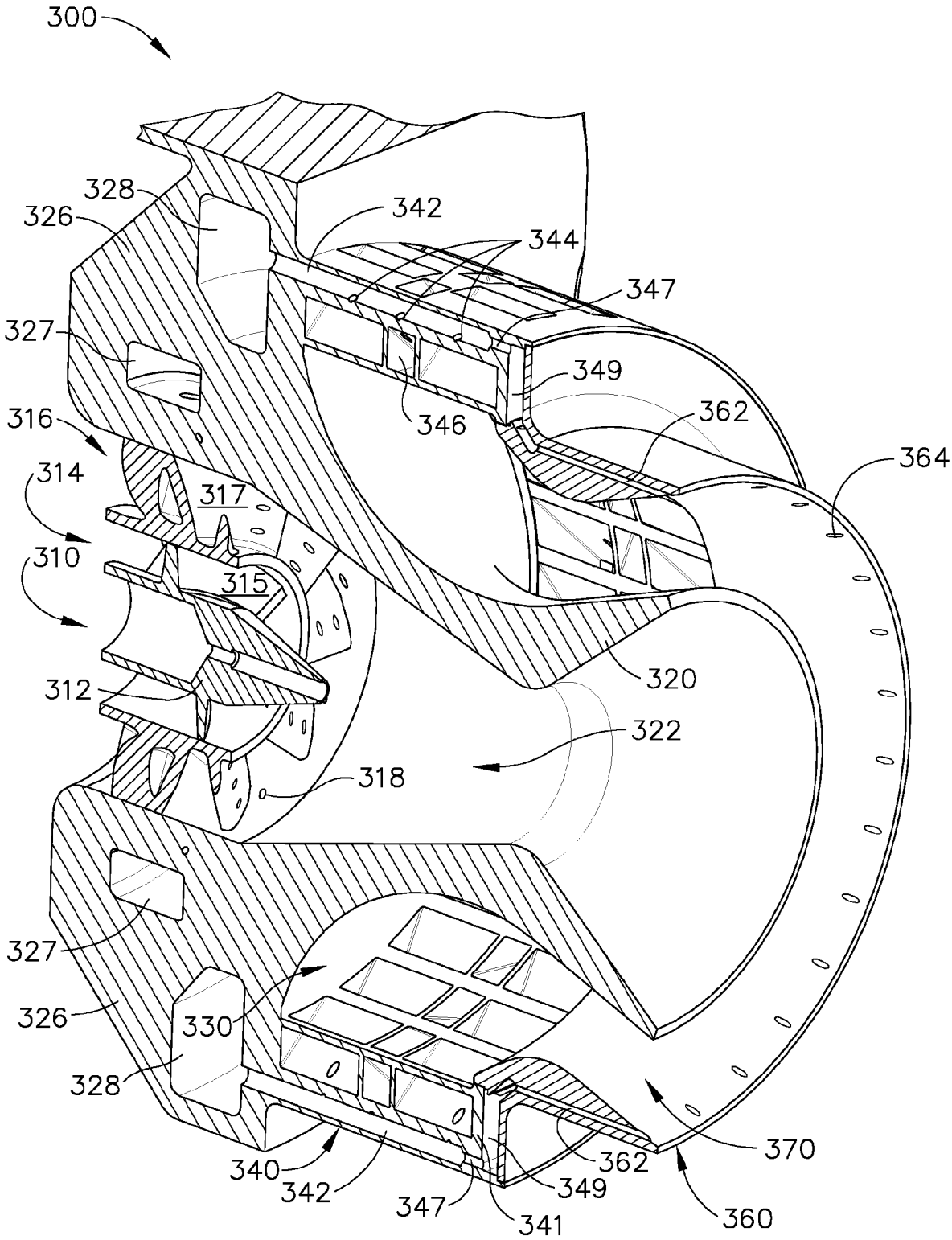
FIG. 5 is an enlarged cross-sectional view of an alternative embodiment of a premixer assembly that may be used with the combustor shown in FIGS. 2 and 3.

FIG. 5 is an enlarged cross-sectional view of an alternative embodiment of a premixer assembly 300 that may be used with the combustor 20 shown in FIGS. 2 and 3. In the exemplary embodiment, premixer assembly 300 includes a pilot swirler 310, an annular centerbody 320, and a main swirler 330. Pilot swirler 310 includes a pilot centerbody 312 having a central rotational axis, an inner annular swirler 314, and a concentrically disposed outer annular swirler 316. Inner annular swirler 314 includes a plurality of inner pilot vanes 315 circumferentially disposed about pilot centerbody 312, and is co-axially aligned with the central rotational axis. Outer annular swirler 316 includes a plurality of outer pilot vanes 317 circumferentially disposed about pilot centerbody 312 and inner annular swirler 314, and is co-axially aligned with the central rotational axis.

Annular centerbody 320 is co-axially aligned with the central rotational axis and defines a centerbody cavity 322. Annular centerbody 320 also includes a plurality of orifices 324 coupled, in flow communication, to centerbody cavity 322. Moreover, annular centerbody 320 includes a forward end portion 326 defining an annular pilot swirler fuel manifold 327 and an annular main swirler fuel manifold 328. Further, annular centerbody 320 extends between pilot swirler 310 and main swirler 330 to control fuel flow through premixer assembly 300.

Main swirler 330 includes a plurality of main swirler vanes 340 and an annular main swirler shroud 360 that both define an annular main swirler cavity 370. Main swirler vanes 340 include aft ends 341 and are annularly arranged about centerbody 320. Moreover, each main swirler vane 340 includes a plurality of fuel passages.

In the exemplary embodiment, main swirler vanes 340 each include a first primary fuel passage 342, a plurality of injection orifices 344, a plurality of intermediate primary fuel/air passages 346, and an intermediate ELBO fuel passage 347. Moreover, main swirler vanes 340 each partially define an aft ELBO fuel manifold 349. First primary fuel passage 342 is coupled, in flow communication, with main swirler 330 via injection orifices 344. Because first primary fuel passage 342 extends across the entire length of respective main swirler vane 340, each main swirler vane 340 is also coupled, in flow communication, to aft ELBO fuel manifold 349 via intermediate ELBO fuel passage 347.

Annular main swirler shroud 360 is coupled to, and extends aftward from, aft ends 341 of main swirler vanes 340 to partially define each aft ELBO fuel manifold 349. Additionally, annular main swirler shroud 360 includes main ELBO fuel passages 362 and a plurality of ELBO fuel openings 364. Each ELBO fuel opening 364 is coupled, in flow communication, to a respective aft ELBO fuel manifold 349.

During operation of the associated combustor, such as DLE combustor 20 (shown in FIGS. 1-3), a fuel delivery system uses a pilot fuel circuit and a main fuel circuit to supply fuel to a combustion zone, such as combustion zone 40 (shown in FIGS. 1-3). The pilot fuel circuit supplies pilot fuel to pilot swirler 310 via pilot swirler fuel manifold 327. Fuel and air are mixed in inner and outer annular swirlers 314 and 316 respectively, and the fuel-air mixture is supplied through respective pilot vanes 315 and 317 to centerbody cavity 322. Additionally, pilot fuel may also be supplied to pilot swirler 310 via orifices 324.

The main fuel circuit includes a main primary fuel circuit and a main ELBO fuel circuit that supply fuel to main swirler 330 via main swirler fuel manifold 328. In the main primary fuel circuit, main swirler vanes 340 each include primary fuel passage 342 coupled, in flow communication, to intermediate primary fuel/air passages 346 via injection orifices 344. As a result, main primary fuel (not shown) is supplied from main swirler fuel manifold 328 to a primary main fuel injection location, Specifically, main primary fuel is supplied to a portion of main swirler cavity 370 positioned forward of annular main swirler shroud 360.

In the main ELBO fuel circuit, main swirler vanes 340 also include intermediate ELBO fuel passage 347 in addition to first primary fuel passage 342. Therefore, each main swirler vanes 340 is also coupled, in flow communication, to intermediate primary fuel/air passages 346 via intermediate ELBO fuel passage 347. As a result, ELBO fuel (not shown) is supplied from main swirler fuel manifold 328 to a secondary main fuel injection location. More specifically, in the exemplary embodiment, ELBO fuel is supplied to a portion of main swirler cavity 370 that is positioned aft of main swirler vanes 340 and adjacent a fuel-air mixture injection exit plane of main swirler 330.

ELBO fuel is a relatively small portion of the main fuel that is supplied as supplemental fuel into a combustor as compared to an amount of main fuel supplied to a primary main fuel injection location. However, ELBO fuel is supplied into the combustor at a different location than the primary main fuel injection location. More specifically, in the exemplary embodiment, ELBO fuel is supplied downstream of the primary main fuel injection location. Because ELBO fuel is a relatively small portion of the main fuel, it is desirable to control an amount of ELBO fuel supplied by controlling an amount and/or size of intermediate ELBO fuel passages 347.

In the exemplary premixer assembly 300, compared to the primary fuel circuit, the ELBO fuel circuit requires a shorter convective timescale for an ELBO fuel-air mixture to travel from the secondary main fuel injection location to the combustion zone, such as combustion zone 40, where heat release occurs. Therefore, an acoustic frequency interacts differently with ELBO fuel-air mixing at secondary main fuel injection location as compared to primary fuel-air mixing at primary main fuel injection location. Moreover, fuel-air mixture fluctuations that are out-of-phase with respect to each other and at least one fuel-air mixture fluctuation that is out-of-phase with respect to pressure fluctuations in DLE combustors are generated.

Because ELBO fuel circuit facilitates reducing, in a fuel-air mixture, any fuel-air ratio variation that may be caused by fluctuations in a flow rate of fuel and/or a flow rate of compressed air, ELBO fuel circuit facilitates reducing combustion acoustics by reducing an amplitude of pressure fluctuations in DLE combustors. Moreover, ELBO fuel circuit facilitates reducing pressure disturbances in a combustion chamber/zone, such as combustion zone 40, of DLE combustors so that pressure disturbances do not interact with a fuel-air mixing process to reinforce an initial pressure disturbance. Therefore, ELBO fuel circuit facilitates reducing an amplitude of pressure disturbances that may damage components of the DLE combustor. As a result, in the exemplary embodiment, ELBO fuel circuit facilitates increasing operability, reducing emissions, reducing maintenance cost, and increasing life of combustor components.

In the exemplary embodiment, main swirler vanes 340 are each coupled, in flow communication, to primary and secondary main fuel injection locations. Therefore, only one fuel manifold such as, main swirler fuel manifold 328, supplies fuel to each of main primary fuel circuit and main ELBO fuel circuit. As a result, main primary and ELBO fuels cannot be independently varied. Instead, a fuel flow split between primary and ELBO fuel circuits is controlled by effective areas of respective intermediate primary fuel/air passages 346 and intermediate ELBO fuel passage 347 diameters. However, every main swirler vane 340 facilitates supplying both main primary fuel and ELBO fuel into respective primary and secondary main fuel injection locations of main swirler cavity 370. As a result, every main swirler vane 340 facilitates optimizing a level of fuel-air mixing in primary main fuel injection location. Therefore, such arrangement facilitates distributing a fixed percentage of ELBO fuel to the secondary main fuel injection location.

Figure 6:
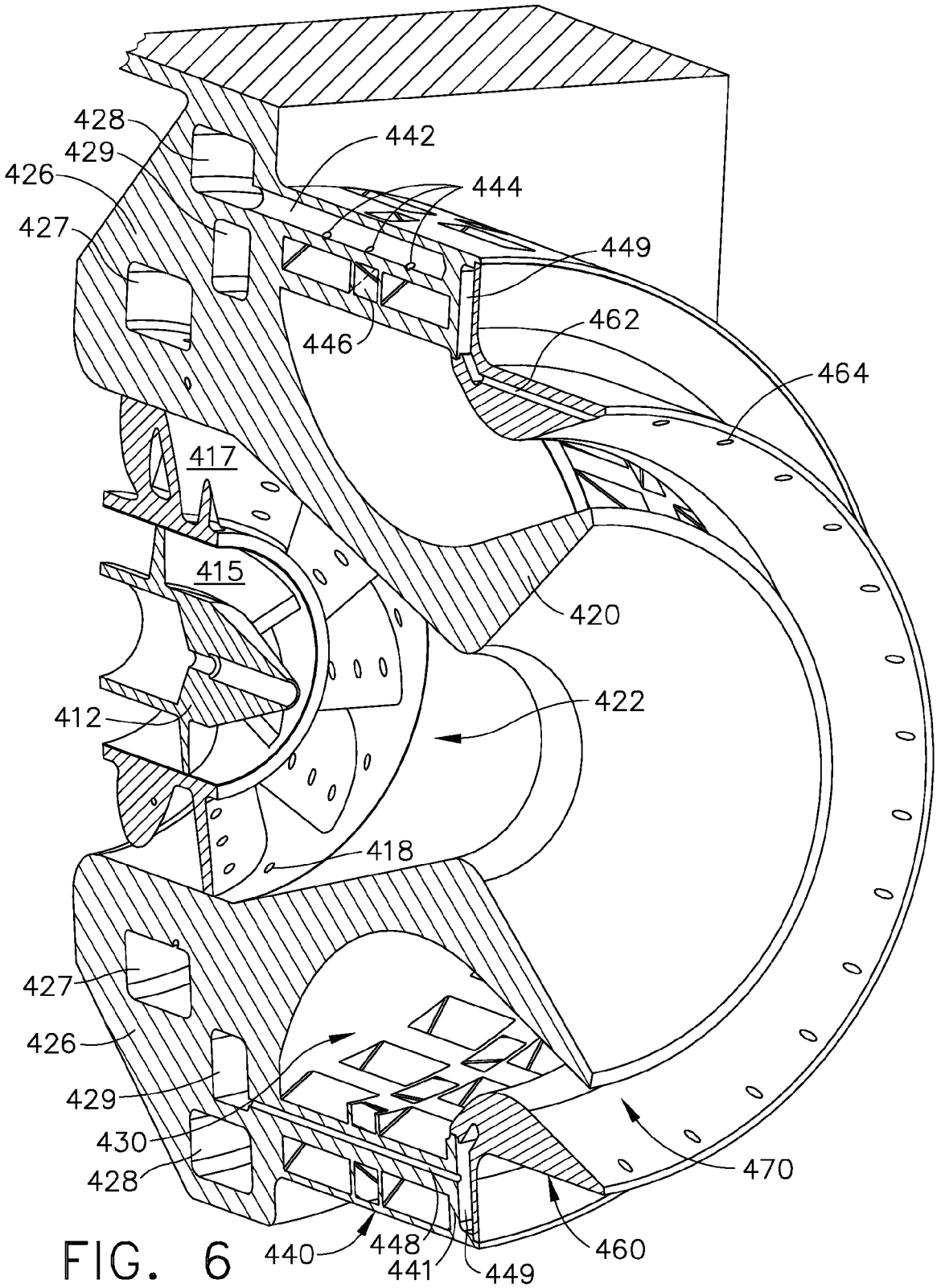
FIG. 6 is an enlarged cross-sectional view of another alternative embodiment of a premixer assembly that may be used with the combustor shown in FIGS. 2 and 3.

FIG. 6 is an enlarged cross-sectional view of another alternative embodiment of a premixer assembly 400 that may be used with the combustor 20 shown in FIGS. 2 and 3. In the exemplary embodiment, premixer assembly 400 includes a pilot swirler 410, an annular centerbody 420, and a main swirler 430. Pilot swirler 410 includes a pilot centerbody 412 having a central rotational axis, an inner annular swirler 414, and a concentrically disposed outer annular swirler 416. Inner annular swirler 414 includes a plurality of inner pilot vanes 415 circumferentially disposed about pilot centerbody 412, and is co-axially aligned with the central rotational axis. Outer annular swirler 416 includes a plurality of outer pilot vanes 417 circumferentially disposed about pilot centerbody 412 and inner annular swirler 414, and is co-axially aligned with the central rotational axis.

Annular centerbody 420 is co-axially aligned with the central rotational axis and defines a centerbody cavity 422. Annular centerbody 420 also includes a plurality of orifices 424 coupled, in flow communication, to centerbody cavity 422. Moreover, annular centerbody 420 includes a forward end portion 426 defining an annular pilot swirler fuel manifold 427, an annular main swirler fuel manifold 428, and an annular forward ELBO fuel manifold 429. Further, annular centerbody 420 extends between pilot swirler 410 and main swirler 430 to control fuel flow through premixer assembly 400.

Main swirler 430 includes a plurality of main swirler vanes 440 and an annular main swirler shroud 460 that both define an annular main swirler cavity 470. Main swirler vanes 440 include aft ends 441 of main swirler vanes 440 and are annularly arranged about annular centerbody 420. Moreover, each main swirler vanes 440 includes a plurality of fuel passages.

In the exemplary embodiment, a first subset of main swirler vanes 440 each include a first primary fuel passage 442, a plurality of injection orifices 444, and a plurality of intermediate primary fuel/air passages 446. Moreover, the first subset of main swirler vanes 440 each partially define an aft ELBO fuel manifold 449. First primary fuel passage 442 is coupled, in flow communication, with main swirler 430 via injection orifices 444. Because first primary fuel passage 242 does not extend across entire length of main swirler vane 440, first primary fuel passage is not coupled, in flow communication, to aft ELBO fuel manifold 449.

A second subset of main swirler vanes 440 each include a second primary fuel passage 448. Moreover, the second subset of main swirler vanes 440 each partially define aft ELBO fuel manifold 449. Because second primary fuel passage 448 extends across the entire length of respective main swirler vane 440, the second subset of main swirler vanes 440 is coupled, in flow communication, to aft ELBO fuel manifold 449. In the exemplary embodiment, main swirler vanes 440 are arranged about a central rotational axis such that each first subset main swirler vane 440 alternates with each second subset main swirler vane 440.

Annular main swirler shroud 460 is coupled to, and extends aftward from, aft ends 441 of main swirler vanes 440 to partially define each aft ELBO fuel manifold 449. Additionally, annular main swirler shroud 460 includes main ELBO fuel passages 462 and a plurality of ELBO fuel openings 464. Each ELBO fuel opening 464 is coupled, in flow communication, to a respective ELBO fuel manifold 449.

During operation of the associated combustor, such as DLE combustor 20 (shown in FIGS. 1-3), a fuel delivery system uses a pilot fuel circuit and a main fuel circuit to supply fuel to a combustion zone, such as combustion zone 40 (shown in FIGS. 1-3). The pilot fuel circuit supplies pilot fuel (not shown) to pilot swirler 410 via pilot swirler fuel manifold 427. Fuel and air are mixed in inner and outer annular swirlers 414 and 416 respectively, and the fuel-air mixture is supplied through respective pilot vanes 415 and 417 to centerbody cavity 422. Additionally, pilot fuel may also be supplied to pilot swirler 410 via orifices 424.

The main fuel circuit includes a main primary fuel circuit and a main ELBO fuel circuit that supply fuel to main swirler 430 via main swirler fuel manifold 428 and forward ELBO fuel manifold 429, respectively. In the main primary fuel circuit, the first subset of main swirler vanes 440 each include first primary fuel passage 442 coupled, in flow communication, to intermediate primary fuel/air passages 446 via injection orifices 444. As a result, main primary fuel (not shown) is supplied from main swirler fuel manifold 428 to a primary main fuel injection location. Specifically, main primary fuel is supplied to a portion of main swirler cavity 470 positioned forward of annular main swirler shroud 460.

In the main ELBO fuel circuit, the second subset of main swirler vanes 440 each include second primary fuel passage 448 coupled, in flow communication, to aft ELBO fuel manifold 449. As a result, ELBO fuel (not shown) is supplied from forward ELBO fuel manifold 429 to a secondary main fuel injection location. More specifically, ELBO fuel is supplied to a portion of main swirler cavity 470 positioned aft of the first and second subsets of main swirler vanes 440 and adjacent a fuel-air mixture injection exit plane of main swirler 430.

ELBO fuel is a relatively small portion of the main fuel that is supplied as supplemental fuel into a combustor as compared to an amount of main fuel supplied to a primary main fuel injection location. However, ELBO fuel is supplied into the combustor at a different location than the primary main fuel injection location. More specifically, in the exemplary embodiment, ELBO fuel is supplied downstream of the primary main fuel injection location. Because ELBO fuel is a relatively small portion of the main fuel, it is desirable to control an amount of ELBO fuel supplied by controlling an amount and/or size of secondary primary fuel passages 448.

In the exemplary premixer assembly 400, compared to the primary fuel circuit, the ELBO fuel circuit requires a shorter convective timescale for an ELBO fuel-air mixture to travel from the secondary main fuel injection location to the combustion zone, such as combustion zone 40, where heat release occurs. Therefore, an acoustic frequency interacts differently with ELBO fuel-air mixing at secondary main fuel injection location as compared to primary fuel-air mixing at primary main fuel injection location. Moreover, fuel-air mixture fluctuations that are out-of-phase with respect to each other and at least one fuel-air mixture fluctuation that is out-of-phase with respect to pressure fluctuations in DLE combustors are generated.

Because ELBO fuel circuit facilitates reducing, in a fuel-air mixture, any fuel-air ratio variation that may be caused by fluctuations in a flow rate of fuel and/or a flow rate of compressed air, ELBO fuel circuit facilitates reducing combustion acoustics by reducing an amplitude of pressure fluctuations in DLE combustors. Moreover, ELBO fuel circuit facilitates reducing pressure disturbances in a combustion chamber/zone, such as combustion zone 40, of DLE combustors so that pressure disturbances do not interact with a fuel-air mixing process to reinforce an initial pressure disturbance. Therefore, ELBO fuel circuit facilitates reducing an amplitude of pressure disturbances that may damage components of the DLE combustor. As a result, in the exemplary embodiment, ELBO fuel circuit facilitates increasing operability, reducing emissions, reducing maintenance cost, and increasing life of combustor components.

In the exemplary embodiment, the first and second subsets of main swirler vanes 440 are respectively coupled, in flow communication, to primary and secondary main fuel injection locations. As a result, every main swirler vane 440 cannot be used to inject main fuel and ELBO fuel into primary main fuel injection location of main swirler cavity 470. Therefore, premixer assembly 400 does not facilitate optimizing a level of fuel-air mixing in primary main fuel injection location to control pollutant formation and combustion acoustics. However, main swirler fuel manifold 428 supplies main primary fuel to main primary fuel circuit and forward ELBO manifold 429 separately supplies ELBO fuel to main ELBO fuel circuit. As a result, main primary and ELBO fuels can be independently varied. Therefore, such arrangement facilitates distributing a variable percentage of ELBO fuel to the secondary main fuel injection location. Moreover, such arrangement facilitates increasing combustor operability.

In each exemplary embodiment, the above-described main swirlers includes ELBO fuel circuits having fuel passages that extend across entire length of a respective main swirler vane. Such fuel passages are coupled, in flow communication, to an aft ELBO fuel manifold. Each aft ELBO fuel manifold is coupled, in flow communication, to main ELBO fuel passages and a plurality of ELBO fuel openings of an annular main swirler shroud.

As a result, ELBO fuel is supplied to a secondary main fuel injection location, which is a portion of a main swirler cavity that is positioned aft of main swirler vanes and adjacent to a fuel-air mixture exit plane of the main swirler. Therefore, fuel-air mixture fluctuations that are out-of-phase with respect to each other and at least one fuel-air mixture fluctuation that is out-of-phase with respect to pressure fluctuations in the combustor are generated to facilitate reducing combustion acoustics by reducing an amplitude of pressure fluctuations in the DLE combustor. Moreover, fluctuations in the fuel and/or compressed air flow rates may be controlled to facilitate reducing an amplitude of pressure disturbances. Further, increasing operability, reducing emissions, reducing maintenance cost, and increasing life of components may be facilitated.

Exemplary embodiments of combustor fuel circuits are described in detail above. The fuel circuits are not limited to use with the combustor described herein, but rather, the fuel circuits can be utilized independently and separately from other combustor components described herein. Moreover, the invention is not limited to the embodiments of the combustor fuel circuits described above in detail. Rather, other variations of the combustor fuel circuits may be utilized within the spirit and scope of the claims.

While the invention has been described in terms of various specific embodiments, those skilled in the art will recognize that the invention can be practiced with modification within the spirit and scope of the claims.

What is claimed is:

1. A method for operating a combustion system including at least one premixer assembly that includes a pilot swirler and a main swirler, said method comprising:

coupling the main swirler to the pilot swirler such that the main swirler substantially circumscribes the pilot swirler;

supplying fuel to a first fuel circuit defined in the main swirler;

inducing swirling to the fuel supplied to the first fuel circuit via a first set of swirler vanes positioned within the main swirler, each of the first set of swirler vanes comprising at least one first fuel passage defined therein;

supplying fuel to a second fuel circuit defined in the main swirler;

inducing swirling to the fuel supplied to the second fuel circuit via a second set of swirler vanes positioned within the main swirler, each of the second set of swirler vanes comprising at least one second fuel passage defined therein; and coupling a shroud in flow communication to at least one of the first set of swirler vanes and the second set of swirler vanes, the shroud comprising at least one third fuel passage defined therein.

2. A method according to claim 1 wherein supplying fuel to a first fuel circuit further comprises supplying fuel from a first annular manifold to said at least one first fuel passage.

3. A method according to claim 2 wherein supplying fuel to a second fuel circuit further comprises supplying fuel from the first annular manifold to said at least one second fuel passage.

4. A method according to claim 3 further comprising:

supplying fuel to at least one common fuel passage of said first fuel passages and said second fuel passages; and inducing swirling to fret supplied to the common fuel passage.

5. A method according to claim 2 wherein supplying fuel to a second fuel circuit further comprises supplying fuel from the first annular manifold to a second annular manifold positioned between the first and second sets of main swirler vanes and the main swirler shroud.

6. A method according to claim 2 wherein supplying fuel to a second fuel circuit further comprises supplying fuel from a third annular manifold to said at least one second fuel passage.

7. A combustion system comprising:

a pilot swirler; and a main swirler coupled to said pilot swirler such that said main swirler substantially circumscribes said pilot swirler, said main swirler comprising:

a first set of swirler vanes for inducing swirling to fuel supplied to a first fuel circuit defined in said main swirler, each of said first set of swirler vanes comprises at least one first fuel passage defined therein;

a second set of swirler vanes for inducing swirling to fuel supplied to a second fuel circuit defined in said main swirler, each of said second set of swirler vanes comprises at least one second fuel passage defined therein; and a shroud coupled in flow communication to at least one of said first set of swirler vanes and said second set of swirler vanes, said shroud comprising at least one third fuel passage defined therein.

8. A combustion system according to claim 7 wherein said shroud facilitates decreasing combustion acoustics generated within said combustion system.

9. A combustion system according to claim 7 wherein said first fuel circuit further comprises a first annular manifold for supplying fuel to said at least one first fuel passage.

10. A combustion system according to claim 9 wherein said second fuel circuit further comprises said first annular manifold for supplying fuel to said at least one second fuel passage.

11. A combustion system according to claim 10 wherein said first fuel passages and said second fuel passages include at least one common fuel passage such that said first and second sets of swirler vanes each induce swirling to fuel supplied to the common fuel passage.

12. A combustion system according to claim 7 further comprising a second annular manifold positioned between said first and second sets of main swirler vanes and the main swirler shroud.

13. A combustion system according to claim 7 wherein said second fuel circuit further comprises a third annular manifold for supplying fuel to said at least one second fuel passage.

14. A fuel delivery apparatus comprising:

a pilot swirler; and a main swirler coupled to said pilot swirler such that said main swirler substantially circumscribes said pilot swirler, said main swirler comprising:

a first set of swirler vanes for inducing swirling to fuel supplied to a first fuel circuit defined in said main swirler, each of said first set of swirler vanes comprises at least one first fuel passage defined therein;

a second set of swirler vanes for inducing swirling to fuel supplied to a second fuel circuit defined in said main swirler, each of said second set of swirler vanes comprises at least one second fuel passage defined therein; and a shroud coupled in flow communication to at least one of said first set of swirler vanes and said second set of swirler vanes, said shroud comprising at least one third fuel passage defined therein.

15. A fuel delivery apparatus according to claim 14 wherein said shroud facilitates decreasing combustion acoustics generated within said combustion system.

16. A fuel delivery apparatus according to claim 14 wherein said first fuel circuit further comprises a first annular manifold for supplying fuel to said at least one first fuel passage.

17. A fuel delivery apparatus according to claim 16 wherein said second fuel circuit further comprises said first annular manifold for supplying fuel to said at least one second fuel passage.

18. A fuel delivery apparatus according to claim 17 wherein said first fuel passages and said second fuel passages include at least one common fuel passage such that said first and second sets of swirler vanes each induce swirling to fuel supplied to the common fuel passage.

19. A fuel delivery apparatus according to claim 14 further comprising a second annular manifold positioned between said first and second sets of main swirler vanes and the main swirler shroud.

20. A fuel delivery apparatus according to claim 14 wherein said second fuel circuit further comprises a third annular manifold for supplying fuel to said at least one second fuel passage.

* * * * *

UNITED STATES PATENT AND TRADEMARK OFFICE

CERTIFICATE OF CORRECTION

PATENT NO. : 7,631,500 B2
APPLICATION NO. : 11/537100
DATED : December 15, 2009
INVENTOR(S) : Mueller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 741 days.

Signed and Sealed this

Second Day of November, 2010

David J. Kappos

David J. Kappos
*Director of the United States Patent and Trademark Office*